United States Patent [19]

Gaiser

[11] 4,270,228

[45] Jun. 2, 1981

[54] HAND COVER

[76] Inventor: Conrad J. Gaiser, 1048 Skyland Dr., Skyland, Zephyr Cove Area, Nev. 89448

[21] Appl. No.: 11,387

[22] Filed: Feb. 12, 1979

[51] Int. Cl.[3] ..... A41D 19/00

[52] U.S. Cl. ..... 2/158; 2/161 R; 2/168

[58] Field of Search ..... 2/167, 168, 161 R, 161 A, 2/16, 17; 521/52

[56] References Cited

U.S. PATENT DOCUMENTS

| | | | |
|---|---|---|---|
| 1,612,822 | 1/1927 | Jones | 2/161 R |
| 1,979,130 | 10/1934 | Wiley | 2/168 |
| 3,063,057 | 11/1962 | Forman | 2/161 R |
| 3,197,786 | 8/1965 | Velonis et al. | 2/167 |
| 3,475,525 | 10/1969 | Peters | 521/52 X |
| 3,476,933 | 11/1969 | Mendelsohn | 521/52 X |
| 3,496,573 | 2/1970 | Kuchar et al. | 2/161 A |
| 4,098,506 | 7/1978 | Gaiser | 74/558 |

FOREIGN PATENT DOCUMENTS

| | | | |
|---|---|---|---|
| 2336006 | 1/1975 | Fed. Rep. of Germany | 2/161 A |
| 2536180 | 2/1977 | Fed. Rep. of Germany | 2/161 A |
| 220467 | 8/1924 | United Kingdom | 2/161 R |
| 547946 | 9/1942 | United Kingdom | 2/161 A |

*Primary Examiner*—H. Hampton Hunter
*Attorney, Agent, or Firm*—Robert E. Strauss

[57] ABSTRACT

There is disclosed a hand cover such as a glove or mitten having at least a portion of its frontal surface bearing an outwardly exposed thin pad of reticulated plastic foam. Reticulated plastic foam is a non-capillary, open skeletal fibrous structure that is obtained from open cell plastic foam by destroying a substantial quantity of the cell walls with a suitable treatment, leaving an intertwined skeletal fibrous structure. In various embodiments, the thin pad of reticulated foam overlies the palm, the frontal surfaces of the fingers, the entire frontal surface of the hand, or the entire hand. The reticulated foam provides a vastly superior grip to objects such as tools, bats, rackets and the like.

19 Claims, 13 Drawing Figures

FIGURE 1
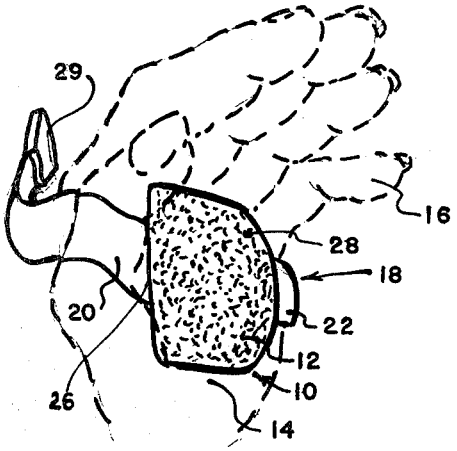
FIGURE 2
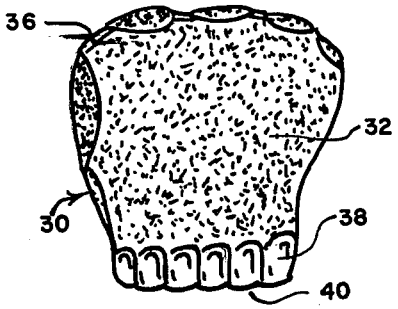
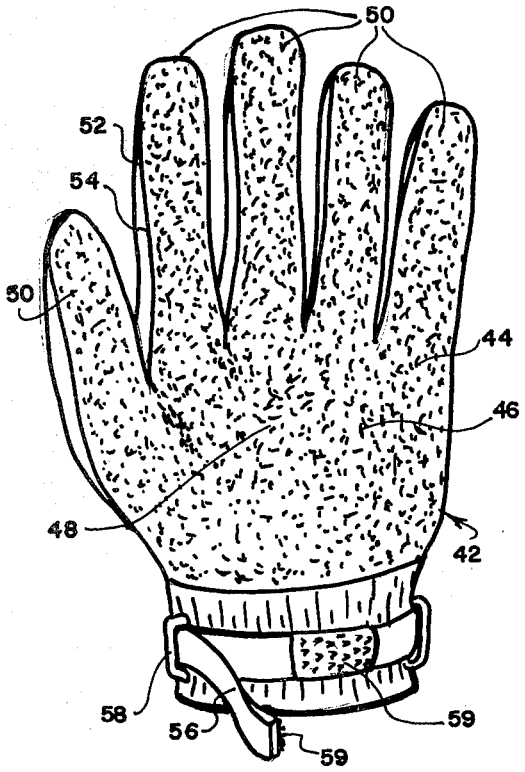
FIGURE 3
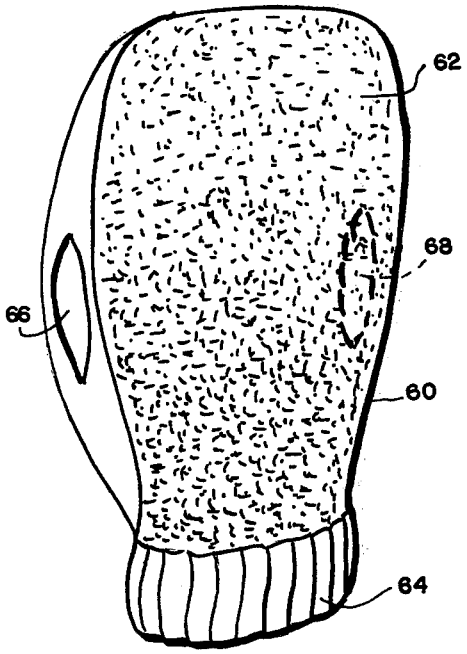
FIGURE 4

FIGURE 5
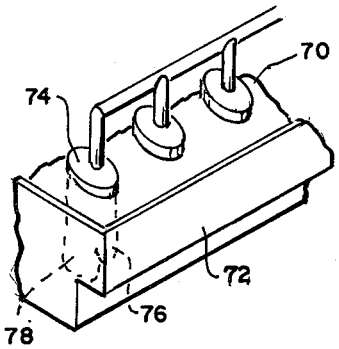
FIGURE 6
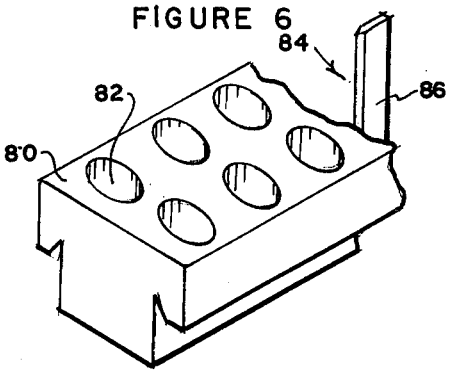
FIGURE 7
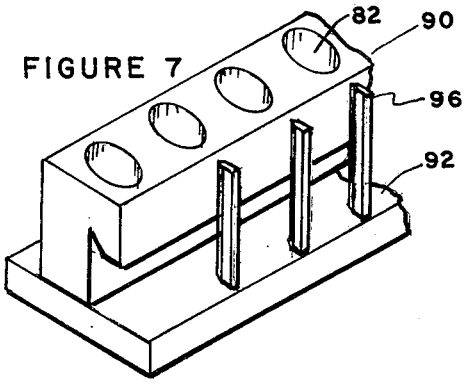
FIGURE 8
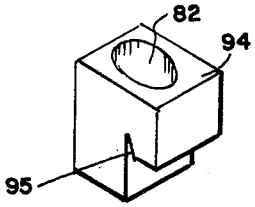
FIGURE 9
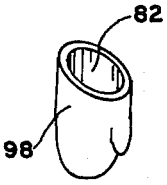
FIGURE 10
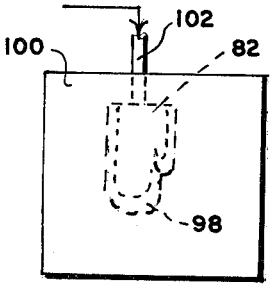
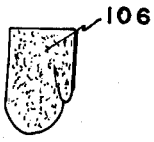
FIGURE 11
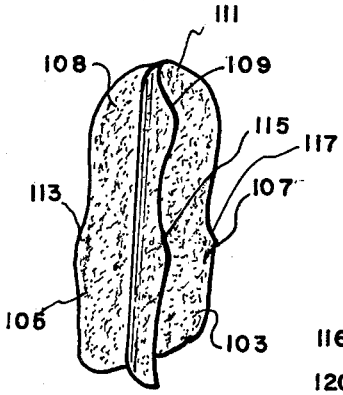
FIGURE 12
FIGURE 13
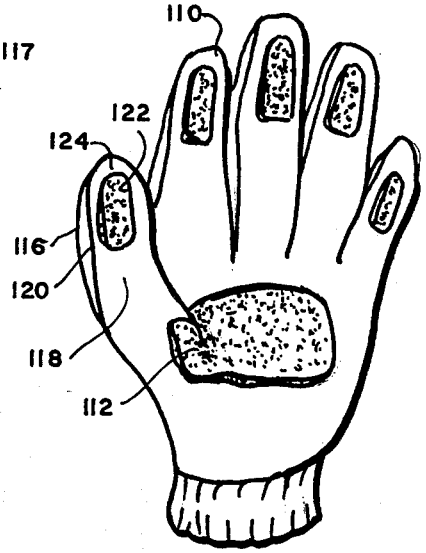

HAND COVER

BACKGROUND OF THE INVENTION

1. Field of Invention

The invention relates to a hand cover and, in particular, to a glove or mitten having a superior grip.

2. Brief Description of the Prior Art

A universal problem encountered by workers and athletes is that wet objects are difficult to grip and when the hand becomes wet with perspiration or oil, a secure grip cannot be maintained without great difficulty. Prior investigators have suggested the use of sleeve coverings and wraps of various materials which are applied to the handles of tools and rackets to avoid this problem. These coverings all suffer from a number of shortcomings and, in my prior patent, U.S. Pat. No. 4,098,506, I disclose an improved sleeve covering for tools and racket handles which is formed of reticulated foam that provides a firm gripping surface even when wet.

In my copending prior application, Ser. No. 904,538, filed on May 10, 1978, I disclose the application of a tape of reticulated foam that is applied as a wrapping to the handle of tools and the like.

A difficulty with covering handles of tools and the like is that the coverings are not readily or immediately removeable and, in addition, a large number of objects are not adaptable to covering with sheet material. To illustrate, wet ropes, fish and watermelons are all difficult to grasp when wet and are not adaptable to covering with the reticulated foam.

BRIEF DESCRIPTION OF THE INVENTION

This invention comprises a hand cover having at least a portion of its frontal surface bearing an exposed, thin pad of reticulated plastic foam. The hand cover includes hand engaging means such as a fabric band, the back surfaces of a glove or mitten and the like to secure the pad of reticulated foam in place. Reticulated foam used in the invention is plastic foam which has an open, skeletal framework that is formed by collapsing a substantial portion of its cell walls. This is accomplished by thermal and/or chemical treatment. The reticulated foam retains a high degree of friction even when wet and the openness and permeability of the pad of reticulated plastic foam permits free air circulation as the user's hand grasps and releases objects, promoting evaporation and expiration of water, perspiration, oil and the like.

BRIEF DESCRIPTION OF THE DRAWINGS

The invention will be described with reference to the FIGURES of which:

FIG. 1 illustrates a simple embodiment of the invention on a wearer's hand;

FIG. 2 illustrates another embodiment of the invention;

FIG. 3 illustrates a glove embodiment of the invention;

FIG. 4 illustrates a thumb-less mitten embodiment of the invention;

FIGS. 5–11 illustrate a method of manufacture; and

FIGS. 12 and 13 illustrate other embodiments of the invention.

DESCRIPTION OF PREFERRED EMBODIMENTS

Referring now to FIG. 1, the invention is shown as a hand cover 10 formed with a thin pad 12 of reticulated plastic foam which is of a size and shape to overlie the palm 14 of the wearer's hand 16. The hand cover includes hand engaging means 18 in the form of a pair of fabric bands 20 and 22 which are distally secured to opposite sides 26 and 28 of the pad 12 and which bear, at their free ends, coacting fastening means 29 such as conventional Velcro hook and loop fasteners. Alternatively, a single elastic band can be used. Other fastening means can include snap fasteners, hook fasteners and the like, all as known to those in the apparel industry.

Referring now to FIG. 2, the hand cover 30 is shown as a fingerless glove having a front surface 32 that comprises a thin pad 34 of the reticulated plastic foam which is bonded, cemented, fused or sewn with an edge seam 36 to the sheet material that forms the balance of the cover 30. Suitable sheet material for this purpose can include vinyl plastics, e.g., polyvinyl chloride, urethanes, such as polyurethane, leather, or fabric woven of fibers of wool, cotton, Nylon, polyester, etc. When the sheet material of the remainder of the glove is of a thermoplastic material such as the vinyl plastics, the seam 36 between the pad 32 of the reticulated plastic foam and the vinyl plastic can be made by fusing the reticulated foam edges to the edge of the vinyl plastic. Other means such as cementing with contact cement or stitching with thread can, of course, be employed.

The hand cover 30 can also include an elastic band 38 about the lower open end 40 of the hand cover.

Referring now to FIG. 3, the invention can comprise a glove 42 having at least its frontal surface 44 as an exposed, thin pad 46 of the reticulated plastic foam. In the illustrated embodiment, the entire frontal surface, including the surface 48 overlying the palm as well as the frontal surfaces 50 of each of the fingers of glove 42 is formed of the reticulated plastic foam. The back surface 52 of the glove 42 can also be formed of the reticulated foam, however, it is preferred that this surface be formed of sheet material such as a vinyl plastic, leather, or fabric, such as wool or cotton. The frontal surface of reticulated foam can then be joined to the back surface of sheet material by a seam 54, again by any suitable means such as stitching or cementing, or, where applicable, thermal fusion. The glove can have a wrist band 56 which can be of elastic material that passes through loops 58 and has fastening means such as the coacting Velcro fasteners 59.

The invention can also be in the form of a mitten such as shown in FIG. 4. As there illustrated, the mitten 60 is integrally formed of plastic foam and at least the frontal face 62 of the mitten 60 is formed of the reticulated plastic foam. In the preferred embodiment, the entirety of the mitten 60 is formed of the reticulated plastic foam and slits 66 and 68 are provided on its opposite side edges to receive the wearer's thumb. This permits reversing of the mitten 60, back-to-front, on a wearer's hand. If desired, an elastic band 64 can be provided around the bottom, open end of the mitten to secure it to the wrist of the wearer.

Referring now to FIGS. 5–11, a method for manufacture of the glove or mitten of the invention is disclosed. As there disclosed, the foam such as a polyurethane foam 70 is formed in the conventional polyurethane foaming technique wherein the reactants of a polyol, such as polyester or polyether bearing reactive hydroxyl groups and an isocyanate, such as tolylene diisocyanate and a blowing agent, e.g., water, are admixed in an open vessel 72 and react therein under conditions to form an open cell foam. A plurality of mold forms 74 are lowered into the foaming reactants during the manufacture of the foam. These forms 74 can be coated with a suitable parting agent and have the general external shape of a human hand with a thumb section 76 and a solid finger portion 78.

The foamed polyurethane reactants form about the forms 74 and after the resin has cured, the bun 80 of the cured resin is removed from the containing vessel 72 and the mold forms 74 are removed, forming a polyurethane bun having a plurality of cavities 82 therein. The bun is passed through a cutting station 84 where it is subdivided by a plurality of cutting blades, hot wires and the like, generally designated at 86, into a plurality of cores 88 and 90 of polyurethane. The latter are passed through cutting station 92 where they are further subdivided into a plurality of mitten pre-forms by knives 96 at cutting station 92.

Referring now to FIG. 8, each of the preforms 94 is a hollow core block of foam having a traverse slot 95. These blocks are trimmed into the general configuration of a mitten shown as 98 in FIG. 9. The trimmed preforms are then passed to a reticulation treatment step in chamber 100, FIG. 10. The foam is reticulated by introduction of a heated gas through line 102 and into the interior cavity 104 of each preform 98. As the gas passes through the open cell polyurethane foam, it heats the foam and melts a substantial portion of the membraneous cell walls without melting the skeletal network strands of the foam structure. This method for reticulation is substantially the same as that described in U.S. Pat. No. 3,475,525. In other reticulation methods, an oxidizing agent can be used to dissolve the membraneous cell walls in the manner described in U.S. Pat. No. 3,476,933.

The finished mittens 106 are recovered from the process as illustrated in FIG. 11. Each mitten is formed of the reticulated plastic foam which is a flexible, compressible plastic foam having a three-dimensional structure of skeletal strands. The foam can be provided in a range of pore size from 10 to about 100 pores per inch, and is controlled by the conditions of the foaming in the manufacture of the open cell polyurethane foam bun 80, and the degree of after treatment. Preferably, foams having a medium to coarse texture, i.e., from 60 to about 10 pores per inch are prepared. Various plastic foams can be reticulated such as foams of polyurethane, polyester, polyether, polyester-base urethane, polyether-base urethane or polyolefins, e.g., polypropylene. Of these, reticulated foams of polyurethane and/or polyether base urethane are most suitable for use in the invention, the latter being particularly preferred because of their high resistance to oils, moisture and solvents.

FIG. 12 illustrates another embodiment of a reversible, back-to-front or hand-to-hand, cover. The hand cover is formed by bonding together the edges of opposite layers of sheet foam. The layers 108 and 109 are partially peeled back in the illustration to show the construction. The layers can be die cut from reticulated foam sheet of suitable thickness, e.g., from 1/16 to about ½ inch, preferably from ⅛ to about ⅜ inch. Two layers, 108 and 109 are cut from the sheet with identical patterns. The layers are overlaid and bonded along their joined edges such as edge 111 that extend about the fingers, and side edges 103 and 105 which extend along the sides of the bottom of the hand. The layers are not joined at the opposite middle edges to provide slits 107 and 113 to receive the wearer's thumb. Each layer has a protruding area 115 and 117 that will overlie the base of the wearer's thumb to enhance the grip of the hand cover. The bonding of the edges of layers 108 and 109 can be accomplished by adhesives such as contact cement.

Referring now to FIG. 13, another embodiment of the invention is illustrated. As there illustrated, an otherwise conventional glove 110 is formed of sheet material such as vinyl plastics, leather, or fabrics such as wool or cotton. A thin pad 112 of reticulated plastic foam is adhesively bonded over the palm portion 114 of the glove. The glove 110 is formed in a conventional manner from a back portion 116 and a front portion 118 which are joined together by a seam 120. Optionally, a plurality of small, thin pads 122 of reticulated foam are adhesively bonded to frontal portions of the fingers of the glove, typically one or two of such portions can be adhesively bonded to the frontal portion 124 of each finger of the glove. The glove illustrated in FIG. 13 is particularly useful in cold climates where the wearer must grip wet or slippery objects, e.g., fishermen who must grasp wet ropes or fish; or skiers who wish to have a secure grasp of ski poles. Contact cements are useful for securing the pad of reticulated foam and an example of commercially available contact cements are Wilhold Brand of Wilhold Glue, Inc., Sante Fe Springs, California.

The flexible, reticulated open-celled foam employed for the thin pads disposed on the frontal surfaces of the hand covers of the invention are commercially available from a number of suppliers such as Wilshire Foam Products, Carson, California, which markets a number of reticulated foams under a Scott designation. The reticulated plastic foams are readily compressible and capable of substantial deflection under minor compressive loading. The ease of compressibility of the aforementioned materials can be expressed by the amount of force required to compress the materials to a designated deflection. In the instant invention, reticulated materials having compressive loadings from 1.4 to about 4 psi at 80% deflection are suitable for use in the invention.

The reticulated polyurethane plastic foam also has a very high tensile strength compared to other flexible foam materials. Typically, this material has a tensile strength from 35 to about 100 psi and is thus readily suited for fabrication of the entire hand cover since the material does not readily tear when in use.

The hand cover of the invention achieves results not accomplished by any prior art glove. The hand cover is formed of inexpensive and readily available materials and can be disposed of when it has served its usefulness. The material is quite compressible and there is no significant loss of the kinesthetic perception of the tool position when grasped in a wearer's hand. The porous structure of the material also provides a coarse or rough surface which engages the tool handle with maximum frictional engagement and thereby insures against unintentional rotation of a tool handle in the user's hand.

The reticulated, open cell plastic foam for the hand cover has a very low capillary structure and this is reflected in a low water retention capacity. Typically, the maximum amount of water retained by the reticulated plastic foam is no greater than about 10 volume percent. The limited water retention capacity insures that the material readily breathes in use and moisture is expelled rather than retained, thereby retaining its natural lightness and a very high frictional characteristic.

The following tabulates experimental data on the water retention of the foam and compares it to a common open cell material:

| | Reticulated Foam | Sponge* |
|---|---|---|
| Dry Weight | 6.4 grams | 20.4 grams |
| Container weight | 5.7 grams | 5.7 grams |
| Wet weight | 40.3 grams | 236.7 grams |
| Weight of water | 28.2 grams | 210.6 grams |
| Foam volume, cubic inches | 18.28 | 18.75 |
| Volume percent water | 9.4% | 68.5% |

*A common cellulose kitchen sponge.

The non-capillary, porous, open cell structure of the material insures a very desirable ventilation in use. The material undergoes repeated compression and expansion, experiencing approximately an eight fold volumetric change as the wearer's grip is relaxed and tightened during use. This imparts a pumping action to the pad of reticulated plastic foam, forcefully circulating air through the reticulated pad and evaporating moisture and oil. As a consequence, the hand cover can be worn by a user over a prolonged period of time of strenuous exercise without causing any discomfort or tendency to slip on an article grasped by the wearer. The hand covers can also be washed to remove any salts or oils which may accumulate in the foam.

Additionally, the extremely low density of the material employed for the manufacture of the hand cover insures that there will be minimal fatigue by the wearer. Typically, a hand cover for use in accordance with the invention weighs than about $\frac{1}{3}$ ounce and this weight is so minimal that it does not cause fatigue to the wearer.

The invention has been described with reference to the illustrated and preferred embodiments. It is not intended that the invention be unduly limited by this illustration of the preferred embodiments. Instead, it is intended that the invention be defined by the means, and their obvious equivalents, set forth in the following claims.

What is claimed is:

1. A hand cover which comprises a thin pad of a reticulated plastic foam with a thickness from 1/16 to about $\frac{1}{2}$ inch to enhance gripping of a tool grasped by the wearer without a significant loss of the kinestatic preception of the tool position, said pad being the only cover overlying the palm of a wearer's hand, and binding means engageable about said hand to retain said cover on the wearer's hand.

2. The cover of claim 1 wherein said thin pad of reticulated plastic foam is of a size and shape to overlie the wearer's palm and said binding means comprises flexible sheet means to encircle the wearer's hand.

3. The cover of claim 2 wherein said flexible sheet means comprises elastic strap means.

4. The cover of claim 2 wherein said flexible sheet means comprises a pair of fabric bands, each distally secured to opposite sides of said thin pad and each bearing, at its opposite end, cooperative band engaging means.

5. The cover of claim 1 wherein said thin pad of reticulated plastic foam is of a size and shape to overlie the frontal surfaces of fingers of a wearer's hand.

6. A glove having a frontal surface comprising a thin pad of a reticulated plastic foam with a thickness from 1/16 to about $\frac{1}{2}$ inch as the only cover overlying the palm of a wearer's hand to enhance gripping of a tool by the wearer without a significant loss of the kinestatic preception of the tool position grasped by the wearer.

7. The cover of claim 6 wherein the entire glove is formed of said reticulated plastic foam.

8. The cover of claim 6 wherein the back surface of said glove is of open-cell, non-reticulated foam integrally formed with said pad of reticulated plastic foam.

9. The cover of claim 6 wherein the back surface of said glove is formed of non-cellular sheet material of plastic, fabric or leather.

10. The cover of claim 1 in the form of a mitten having a frontal surface of said thin pad of reticulated plastic foam.

11. The cover of claim 1 formed by edge bonding two cut layers of reticulated foam having a thickness from $\frac{1}{8}$ to about $\frac{3}{8}$ inch.

12. The cover of claim 11 wherein said layers are bonded about their finger edges and opposite side edges with an intermediate unbonded side edge to provide a slit to receive a wearer's thumb.

13. The cover of claim 12 wherein intermediate unbonded edges are provided on opposite sides of said cover to permit its reversal, back-to-front, or hand-to-hand.

14. The hand cover of claim 1 wherein said pad is formed of reticulated polyurethane foam.

15. The hand cover of claim 7 wherein said pad is formed of reticulated polyurethane foam.

16. The hand cover of claim 11 wherein said pad is formed of reticulated foam.

17. The hand cover of claim 13 wherein said pad is formed of reticulated foam.

18. The cover of claim 14 wherein said foam is of a coarse texture having from 60 to 10 pores per inch.

19. The cover of claim 1 wherein said layers of foam have thicknesses from $\frac{1}{8}$ to $\frac{3}{8}$ inch.

* * * * *